US005409388A

United States Patent [19]

Phillips, Jr. et al.

[11] Patent Number: 5,409,388

[45] Date of Patent: Apr. 25, 1995

[54] IGNITION CABLE ASSEMBLY

[75] Inventors: William T. Phillips, Jr., Boardman; Michael J. Bezusko, Warren; Vincent J. Tura, Jr., Niles, all of Ohio; Keith A. Penney, Davison, Mich.

[73] Assignee: General Motors Corporation, Detroit, Mich.

[21] Appl. No.: 172,315

[22] Filed: Dec. 23, 1993

[51] Int. Cl.[6] ..... H01R 13/187

[52] U.S. Cl. ..... 439/125; 439/271; 439/843

[58] Field of Search ..... 439/125–128, 439/271, 843; 123/169 P, 169 PA, 169 PH

[56] References Cited

U.S. PATENT DOCUMENTS

| | | | |
|---|---|---|---|
| 4,621,881 | 11/1986 | Johansson et al. | 439/125 |
| 4,701,662 | 10/1987 | Yamanashi et al. | 439/125 |
| 4,906,202 | 3/1990 | Germ | 439/125 |
| 5,179,327 | 1/1993 | Yagi et al. | 439/125 |

*Primary Examiner*—Gary F. Paumen
*Attorney, Agent, or Firm*—William A. Schuetz

[57] ABSTRACT

An ignition cable assembly includes a cable terminal attached to an end of an ignition cable. The cable terminal is plugged into the end of a boot and terminal subassembly that comprises three parts. These are a base terminal, a snap ring insert and an elastomeric boot. The elastomeric boot houses a replaceable plug seal that engages a ceramic insulator of a spark plug when the ignition cable assembly is plugged onto the spark plug. The ignition cable assembly can be straight, bent or right angled.

17 Claims, 4 Drawing Sheets

IGNITION CABLE ASSEMBLY

BACKGROUND OF THE INVENTION

This invention relates to ignition cable assemblies and more specifically to ignition cable assemblies that have a terminal attached to the end of the ignition cable and encased within a flexible elastomeric nipple or boot that provides the primary environmental seal and dielectric insulation for the terminal when it is plugged onto a spark plug.

The primary function of such an ignition cable assembly is to maintain an adequate mechanical, electrical and dielectric connection of the ignition cable to the spark plug while allowing repetitive removals and reconnections for spark plug changes.

Traditional ignition cable assemblies have a number of shortcomings. The terminals are prone to deformation and damage by repeated engagement and disengagement with the terminal of the spark plug. This results in reduced engagement capacity and possible microarcing due to insufficient terminal contact. The microarcing in turn leads to wear and premature failure of the cable conductor.

Another problem is that the force required to disconnect the terminal can increase in use at engine operating temperatures so that the disconnect force exceeds the terminal to cable retention force. This results in terminal pull off when the ignition cable assembly is disconnected for spark plug replacement.

Another problem is that the elastomeric boot can bond to the ceramic insulator of the spark plug after some period of use in an engine operating temperature environment. This results in the elastomeric boot being susceptible to damage when the ignition cable assembly is disconnected. Possible known solutions for this problem include ribbed insulator geometries and interface lubricants and coatings, such as powders, greases, glazes, etc. However, these solutions are not entirely satisfactory, particularly in high operating temperature environments and extended service interval situations.

Another problem associated with the general type of ignition cable assembly discussed above is degradation of the electrical seal between the boot and the insulator of the spark plug. This results from the loss of seal pressure due to compression set of the elastomeric boot and/or tearing of the elastomeric boot upon removal due to adhesion to the insulator of the spark plug. A proposed solution to this problem is the use of ribs on the insulator of the spark plug. This increases the distance from the spark plug terminal to the spark plug shell thereby increasing the voltage required for arcing from terminal to shell. However, this solution produces air gaps or passages between the boot and the insulator that connect interior spaces of the boot with the environment. At system operating voltages, air in these spaces and passages is ionized resulting in corona discharge along the interface between the boot and the insulator which can lead to eventual dielectric breakdown or punctures of the boot. This in turn limits the amount of voltage that can be applied to the ignition cable assembly and spark plug.

Another problem is that the cable terminations and the terminals of the prior art ignition cable assemblies have irregular geometries which create high potential gradients that lead to high E-field intensities.

SUMMARY OF THE INVENTION

The object of this invention is to provide an ignition cable assembly that addresses one or more of the problems and shortcomings of the prior art that are discussed above.

Another object of this invention is to provide an ignition cable assembly that has one or more of the following features:

- An ignition cable assembly having a base terminal that has an outer surface that is essentially a smooth cylinder so that an elastomeric boot conforms to virtually eliminate all air gaps or voids at the interface of the base terminal and the elastomeric boot so as to reduce stress and improve seal life;
- An ignition cable having a seal plug in the socket of an elastomeric boot for engaging a ceramic spark plug insulator or the like so as to eliminate bonding of the elastomeric boot to the insulator;
- An ignition cable having a seal plug in the socket of an elastomeric boot for engaging a ceramic spark plug insulator or the like that is replaceable so that the dielectric strength of the seal can be restored;
- An ignition cable assembly having all electrical connections made inside a cylindrical base terminal that is housed in an elastomeric boot;
- An ignition cable assembly having a cable terminal that is attached to an ignition cable and plugs into a base terminal inside an elastomeric boot so that the ignition cable is detachable;
- An ignition cable assembly having a snap ring insert that is totally inside a smooth cylindrical base terminal for making a good mechanical and electrical connection with a spark plug terminal post when the ignition cable assembly is plugged onto the spark plug;
- An ignition cable assembly having replaceable components even when an elastomeric boot is over molded onto a base terminal;
- An ignition cable assembly that is easily adapted to a variety of different configurations of insulated electric devices such as spark plugs because it uses a replaceable seal and a snap ring insert.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
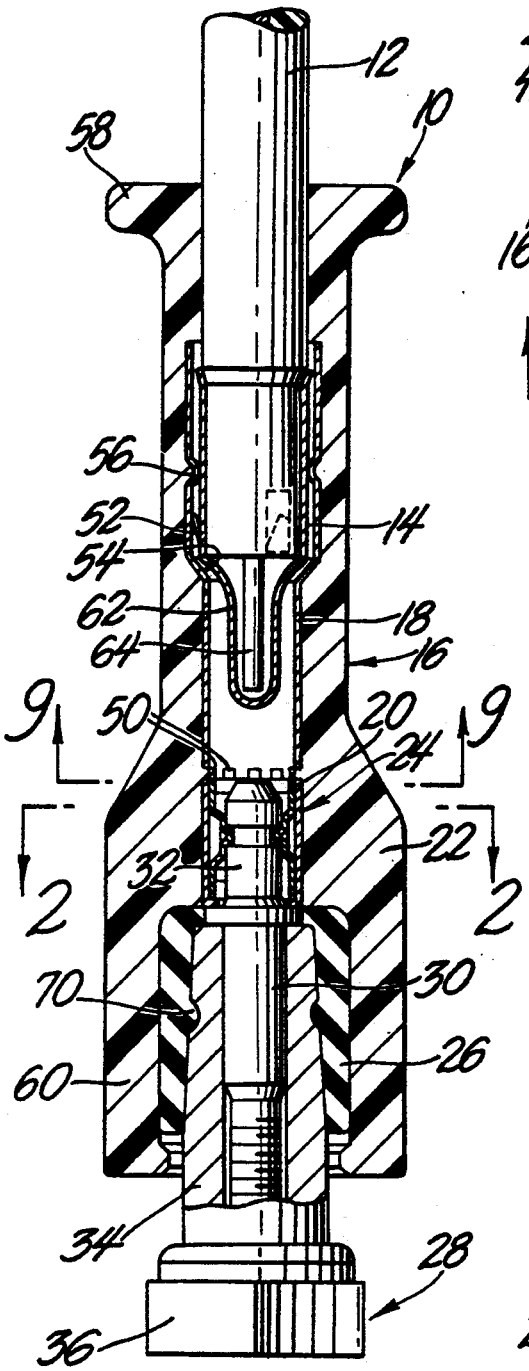
FIG. 1 is a longitudinal section of an ignition cable assembly of this invention connected to a mating terminal of a spark plug.
Figure 2:
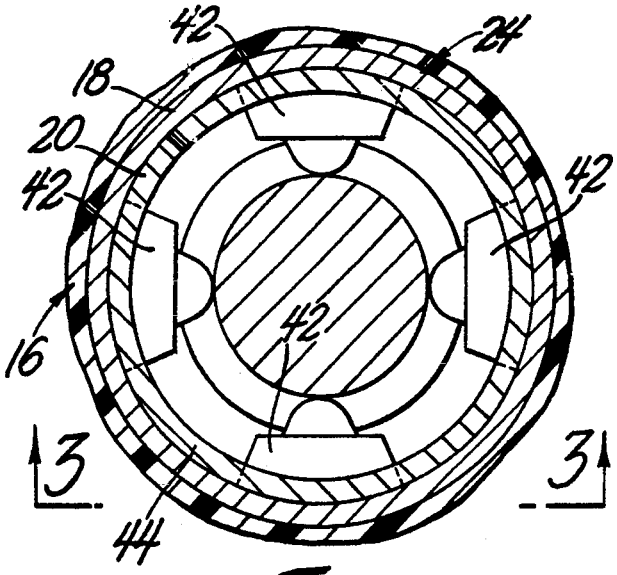
FIG. 2 is a section taken substantially along the line 2—2 of FIG. 1 looking in the direction of the arrows.

Referring now to the drawing, FIG. 1 discloses an ignition cable assembly 10 comprising an ignition cable 12 that has a cable terminal 14 attached to one end. The cable terminal 14 is plugged into the end of a boot and terminal subassembly 16 that comprises three parts. These are a base terminal 18, a snap ring insert 20 and an elastomeric boot 22. The base terminal 18 and the snap ring insert 20 form a further subassembly 24 as explained below. The ignition cable assembly 10 may also include a replaceable plug seal 26 as explained below.

The ignition cable assembly 10 is plugged onto a spark plug 28 comprising an electrode 30 having an exposed spark plug terminal post 32, a ceramic insulator 34 and a metal shell 36. The metal sheath 36 secures the spark plug 28 in a hole in an engine block (not shown) and also serves as an electrical ground in a conventional manner.

Returning now to the ignition cable assembly 10, the base terminal 18 is a deep drawn sheet metal cylinder preferably made of stainless steel. The cylinder has a flange 38 at one end that defines an entrance for a receptacle 40 that houses the snap ring insert 20 completely inside the base terminal 18. The flange 38 guides the spark plug terminal post 32 into the snap ring insert 20 when the ignition cable assembly 10 is plugged onto the spark plug 28.

The snap ring insert 20 comprises a plurality of circumferentially spaced, in this case, four orthogonally related, dimple beams 42 that are attached to two longitudinally spaced end rings 44. The beams 42 have central sections 46 that are depressed radially inwardly of the end rings 44. Each center section 46 has an inwardly projecting dimple 48 at the center. The central sections 46 biasingly engage the spark plug terminal post 32 when it is plugged into the receptacle 40 as shown in FIG. 1. The dimples 48 engage in a circular slot of the spark plug terminal post 32 for enhanced retention.

Figure 3:
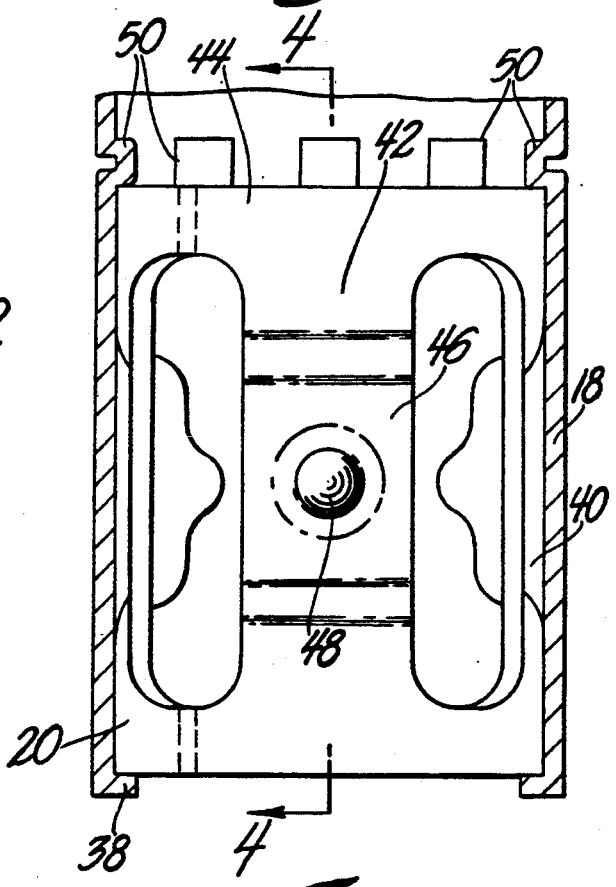
FIG. 3 is an enlarged front view of a snap ring insert installed in the ignition cable assembly that is shown in FIGS. 1 and 2.
Figure 4:
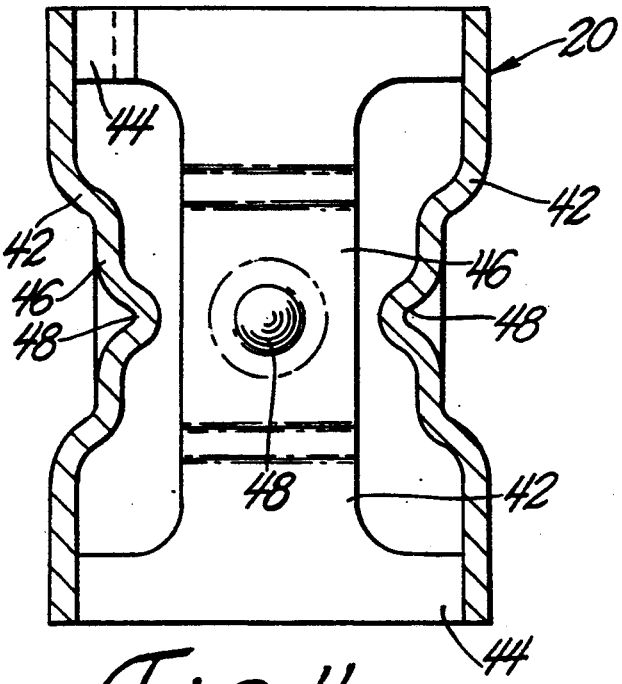
FIG. 4 is a section taken substantially along the line 4—4 of FIG. 3 looking in the direction of the arrows.

The snap ring insert 20 is trapped or retained in the receptacle 40 by the flange 38 and a circumferential series of stops 50 that are formed by punching or indenting the wall of the base terminal 18 as best shown in FIG. 3. The snap ring insert 20 is made by stamping a blank strip of spring tempered stainless steel or other suitable spring-like material and rolling the blanked strip into a ring. Consequently the end rings 44 are split at the juxtaposed ends of the rolled strip.

The snap ring insert 20 is assembled into the receptacle 40 by inserting it into the upper end of the base terminal 18 after the flange 38 is rolled at the lower end and before the stops 50 are punched. Alternatively the snap ring insert 20 can be assembled by inserting it into the lower end of the base terminal 18 after the stops 50 are punched and before the flange 38 is rolled. In either event the snap ring insert 20 is retained in the receptacle 40 so that the snap ring insert 20 and the terminal 18 form the subassembly 24.

The base terminal 18 also has an enlarged receptacle 52 at the upper end, that is, at the end opposite the end of the receptacle 40. The receptacle 52 has a forward annular stop formed by a transition wall 54 of the base terminal 18 and a rearward annular stop formed by rolling a groove 56 in the base terminal 18. The receptacle 52 receives the cable terminal 14 as explained below.

The terminal 18 together with the insert 20 forms a subassembly 24 as indicated earlier. This subassembly in turn forms a part of the larger boot and terminal subassembly 16 that also includes the elastomeric boot 22. The boot 22 can be made of any suitable elastomeric material that is compatible with an engine compartment environment, such as silicone or EPDM rubber. The boot 22 is assembled to the base terminal 18 with the objective of eliminating all air gaps or voids between the elastomeric boot 22 and the base terminal 18. Consequently the outer surface of the base terminal 18 is essentially a smooth cylinder and the snap ring insert 20 is housed totally within the base terminal 18 so that elastomeric boot 22 conforms to the base terminal 18 easily. The elastomeric boot 22 is preferably over molded onto the terminal subassembly 24 so that the elastomeric boot 22 completely eliminates any air gaps or voids at the interface even in the indents for the stops 50. Alternatively the terminal subassembly 24 can be mechanically inserted into a premolded elastomeric boot 22.

The elastomeric boot 22 is shaped with internal stops that cooperate with the enlarged end of the base terminal 18 for retaining the terminal subassembly 24 in the boot. In the case of mechanical insertion, an adhesive can be used to retain the terminal subassembly 24 or supplement the mechanical retention of the internal stops of the boot.

The elastomeric boot 22 has passages at each end that communicate with the respective receptacles 40 and 52 of the base terminal 18; a finger grip 58 at the upper or cable end, and a socket 60 at the lower or plug-on end for receiving the insulator 34 of the spark plug 28 when the ignition cable assembly 10 is plugged onto the spark plug 28.

Figure 6:
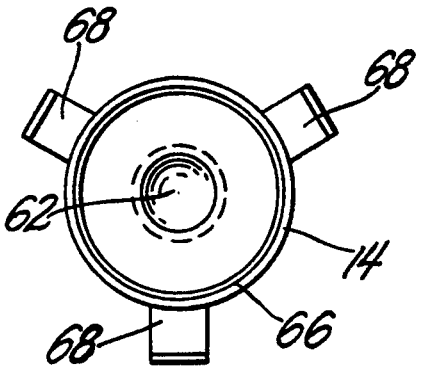
FIG. 6 is a top view of the cable terminal taken substantially along the line 6—6 of FIG. 5 looking in the direction of the arrows.
Figure 5:
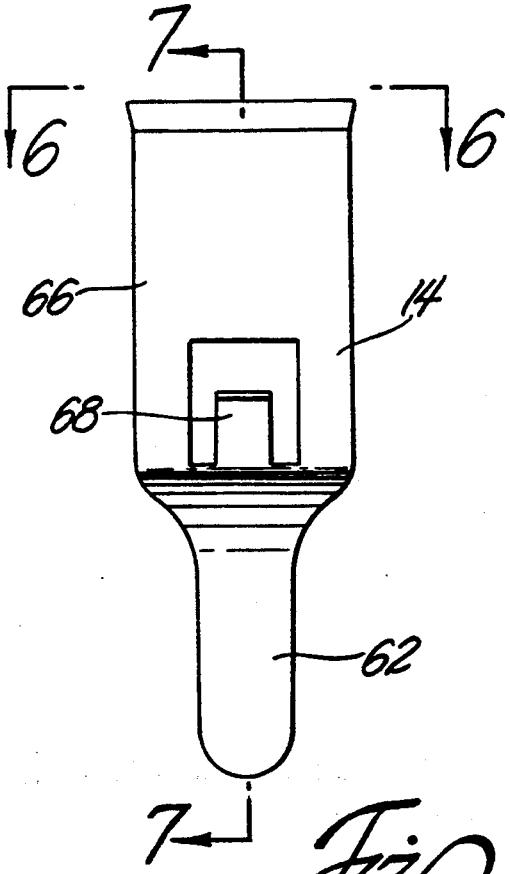
FIG. 5 is an enlarged front view of a cable terminal of the ignition cable assembly that is shown in FIG. 1.
Figure 7:
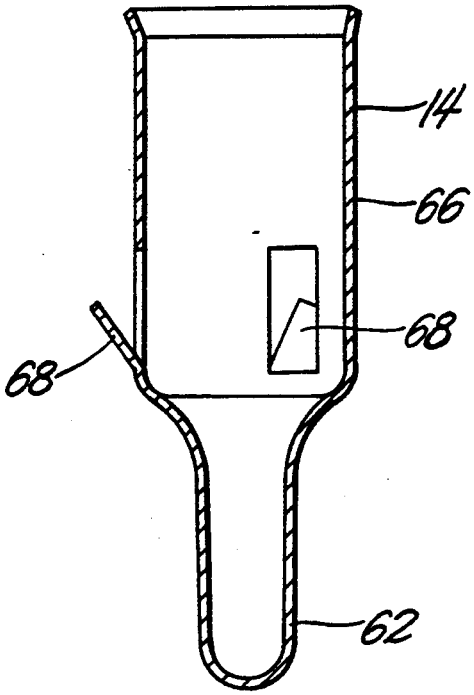
FIG. 7 is a section of the cable terminal taken substantially along the line 7—7 of FIG. 5 looking in the direction of the arrows.
Figure 9:
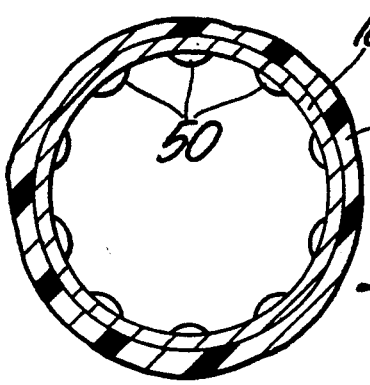
FIG. 9 is a section taken substantially along the line 9—9 of FIG. 1 looking in the direction of the arrows.
Figure 8:
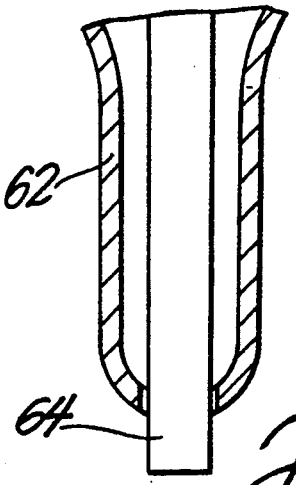
FIG. 8 is a section of a modified cable terminal.

The cable terminal 14 which is also preferably made of stainless steel is shown in detail in FIGS. 5, 6 and 7. It is a cup shaped body that has a integral nipple 62 at a forward end for receiving an insulation stripped end of a conductor core 64 of the ignition cable 12 as shown in FIG. 1. The cup shaped body has a barrel 66 at a rearward end for fastening the cable terminal 14 to the insulation jacket of the ignition cable 12. The cable terminal 14 also includes a plurality of circumferentially spaced, in this case three, lock tangs 68 that are pierced from and bent out of the forward portion of the barrel 66. The cable terminal 14 is suitably attached to the end of the ignition cable 12 electrically and mechanically, preferably by an insulation crimp in the barrel 66 and a conductor core crimp in the nipple 62. Thus the nipple 62 is shaped so that the stripped end of the conductor core 64 is led into the nipple 62 when the end of the ignition cable 12 is inserted into the cable terminal 14. The insulation jacket is also guided into the cable terminal 14 by the lead-in at the rear end of the barrel 66. After insertion, the nipple 62 is crimped onto the conductor core 64 and the barrel 66 is crimped onto the insulation jacket of the ignition cable 12 in any suitable manner. The end of the nipple 62 can be closed as shown in FIG. 7 or it can be open so that the end of the conductor core 64 projects out through the nipple 62 as shown in figure 8. The projecting end provides a visual quality check and an electrical test point.

After the cable terminal 14 is attached to the end of the ignition cable 12, it is inserted through a rear passage of the elastomeric boot 22 and plugged into the receptacle 52 of the base terminal 18 until the lock tangs 68 snap over the rearward stop formed by the rolled groove 56. These lock tangs 68 not only retain the cable terminal 14 in the base terminal 18 but also provide the electrical interface between the cable terminal 14 and the base terminal 18.

The cable terminal 14 is permanently installed. However, the ignition cable assembly that is shown in FIGS. 12 and 13 has a modified cable terminal 314 that can be pulled out.

Figure 12:
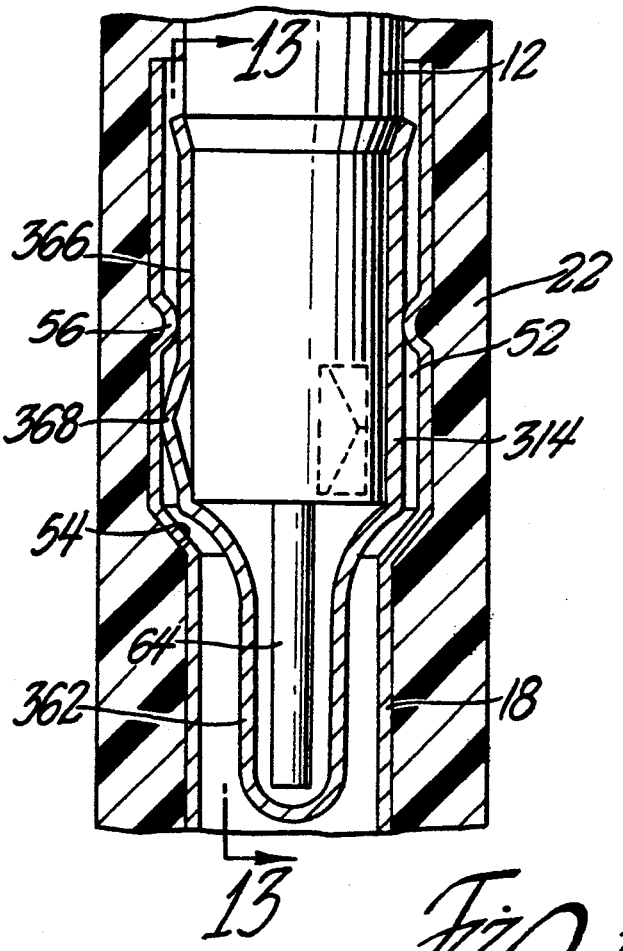
FIG. 12 is a partial longitudinal sectional view of still yet another version of an ignition cable assembly of this invention.
Figure 13:
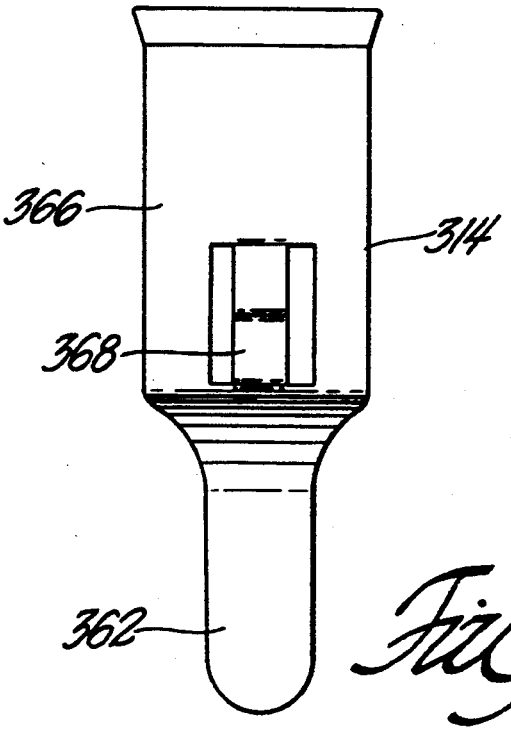
FIG. 13 is a front view of the cable terminal of the ignition cable assembly that is shown in FIG. 12.

The cable terminal 314 which is also preferably made of stainless steel is also a cup shaped body that has a integral nipple 362 at a forward end for receiving an insulation stripped end of the conductor core 64 of the ignition cable 12 as shown in FIG. 12. The cup shaped body has a barrel 366 at a rearward end for fastening the cable terminal 314 to the insulation jacket of the ignition cable 12. The cable terminal 314 also includes a plurality of circumferentially spaced, in this case three, lock members 368 that are pierced from and bent outwardly of the forward portion of the barrel 366. The lock members 368, however, are attached to the barrel 366 at each end to provide depressible beams, that are V-shaped in longitudinal direction.

The cable terminal 314 is suitably attached to the end of the ignition cable 12 electrically and mechanically, preferably by an insulation crimp in the barrel 366 and a conductor core crimp in the nipple 362. Thus the nipple 362 is shaped so that the stripped end of the conductor core 64 is led into the nipple 62 when the end of the ignition cable 12 is inserted into the cable terminal 314. The insulation jacket is also guided into the cable terminal 314 by the lead-in at the rear end of the barrel 366. After insertion, the nipple 362 is crimped onto the conductor core 64 and the barrel 366 is crimped onto the insulation jacket of the ignition cable 12 in any suitable manner. The end of the nipple 62 can be closed as shown in FIGS. 12 and 13 or it can be open so that the end of the conductor core 64 projects out through the nipple as shown in FIG. 8 to provide a visual quality check and an electrical test point.

After the cable terminal 314 is attached to the end of the ignition cable 12, it is inserted through a rear passage of the elastomeric boot 22 and plugged into the receptacle 52 of the base terminal 18 until the peaks of the lock members 368 snap over the rearward stop formed by the rolled groove 56. These lock members 368 not only retain the cable terminal 314 in the base terminal 18 but also provide the electrical interface between the cable terminal 314 and the base terminal 18.

After insertion the modified cable terminal 314 can be pulled out by depressing the lock members 368. Thus the modified cable terminal 314 has the advantage that the modified cable terminal 314 or the cable and terminal subassembly 16 can be replaced without need of scrapping the entire ignition cable assembly 10. Individual components of the Subassembly 6 itself can be replaced if the terminal subassembly 4 is mechanically inserted into a premolded elastomeric boot 22.

As indicated above, the ignition cable assembly 10 shown in FIGS. 1–9 may also include a replaceable plug seal 26. The inner surface of the plug seal 26 is shaped to fit the insulator 34 and includes an integral lock ring 70 that fits into a lock groove of the spark plug insulator 34. The plug seal 26 is made of a suitable elastomeric material that promotes adhesion to the insulator 34, such as silicone rubber. By promoting adhesion between the plug seal 26 and the insulator 34 during engine operation, a very good mechanical seal is made and maintained. When the ignition cable assembly 10 is unplugged to change the spark plug 28, the plug seal 6 remains attached to the insulator 34 and is disposed of with the spark plug 28. The discarded plug seal 26 is then replaced with a new one when the ignition cable assembly 10 is reconnected. The initial plug seal 26 can be included with the ignition cable assembly 10 by housing it in the socket 60 of the elastomeric boot 22, or it can be installed on the spark plug 28 before the ignition cable assembly 10 is attached.

Figure 10:
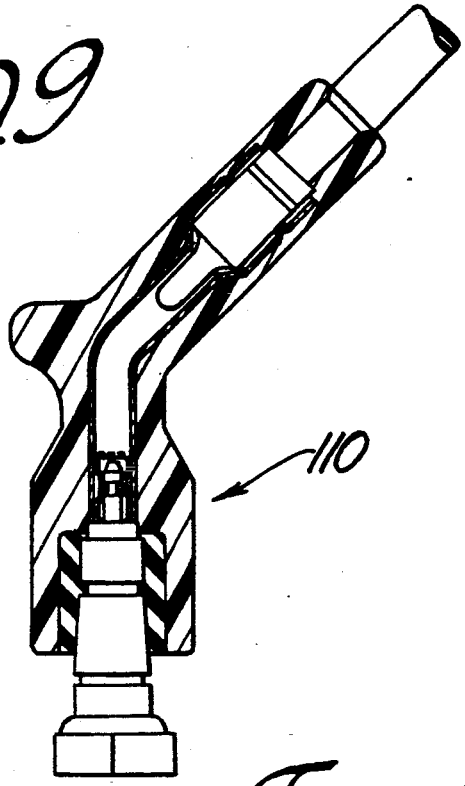
FIG. 10 is a longitudinal sectional view of another version of an ignition cable assembly of this invention.
Figure 11:
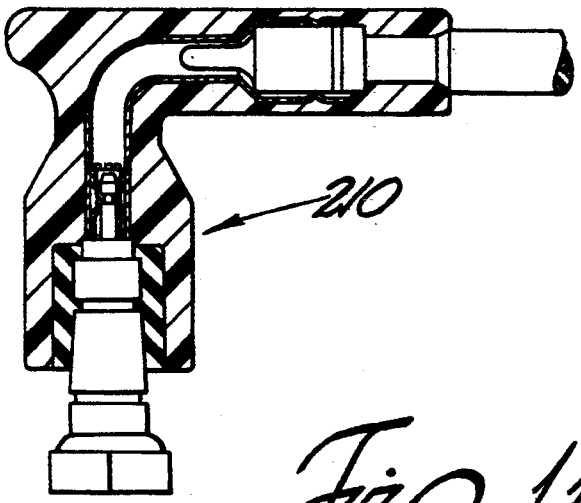
FIG. 11 is a longitudinal sectional view of still another version of an ignition cable assembly of this invention.

While the ignition cable assembly 10 is straight or 180 degrees, the ignition cable assembly can be also be bent or right angled as illustrated by the ignition cable assemblies 110 and 210 shown in FIGS. 10 and 11 respectively.

Moreover the ignition cable assemblies 10, 110 and 210 are not limited to use with the specific spark plug configuration illustrated. They are easily adapted to different configurations of insulated electric devices such as spark plugs by changing the shape of the snap ring insert 10 and/or the plug seal 26.

In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. An ignition cable assembly comprising:

an elastomeric boot having a socket for receiving an insulated electric device having a terminal post and an insulator, and a passage for receiving an ignition cable, a base terminal disposed inside the elastomeric boot, the base terminal having a receptacle communicating with the socket of the elastomeric boot for receiving the terminal post and a receptacle communicating with the passage for receiving the ignition cable, and a replaceable plug seal disposed in the socket of the elastomeric boot for sealingly engaging the insulator of the insulated electrical device.

2. The ignition cable assembly as defined in claim 1 wherein the replaceable plug seal is made of a material that adheres to a ceramic insulator.

3. The ignition cable assembly as defined in claim 2 wherein the plug seal has an internal lock ring.

4. The ignition cable assembly as defined in claim 2 wherein the base terminal has a snap ring insert disposed inside the receptacle for biasingly engaging the terminal post.

5. The ignition cable assembly as defined in claim 4 further including a cable terminal that is attached to an end of the ignition cable and that is disposed in the receptacle of the base terminal that communicates with the passage of the elastomeric boot for receiving the ignition cable.

6. An ignition cable assembly comprising:

an elastomeric boot having a socket for receiving an insulated electric device having a terminal post and an insulator, and a passage for receiving an ignition cable, a base terminal disposed inside the elastomeric boot, the base terminal having a receptacle communicating with the socket of the elastomeric boot for receiving the terminal post and a receptacle communicating with the passage for receiving the ignition cable, and a cable terminal that is attached to an end of an ignition cable and that is disposed in the receptacle of the base terminal that communicates with the passage of the elastomeric boot for receiving the ignition cable.

7. The ignition cable assembly as defined in claim 6 wherein the cable terminal is removably secured in the receptacle of the base terminal so that the cable terminal can be disassembled from the base terminal for replacement of the base terminal and/or the cable terminal.

8. The ignition cable assembly of claim 7 wherein the cable terminal has a plurality of lock members that are depressible beams that are V-shaped in a longitudinal direction.

9. The ignition cable assembly as defined in claim 7 wherein the ignition cable assembly further comprises a replaceable plug seal disposed in the socket of the elastomeric boot for sealingly engaging the insulator of the insulated electric device.

10. An ignition cable assembly comprising:

an elastomeric boot having a socket for receiving an insulated electric device having a terminal post and an insulator, and a passage for receiving an ignition cable, a base terminal disposed inside the elastomeric boot, the base terminal having an outer surface that is essentially a smooth cylinder so that the elastomeric boot intimately engages the outer surface of the base terminal so as to virtually eliminate any air gaps or voids at the interface of the base terminal and the elastomeric boot, the base terminal having a receptacle communicating with the socket of the elastomeric boot for receiving the terminal post and a receptacle communicating with the passage of the insulator jacket for receiving the ignition cable, the base terminal is configured so that the electrical connections with the terminal post and the ignition cable are made inside the respective receptacles, and a cable terminal that is attached to the ignition cable and that is disposed inside the receptacle of the base terminal that communicates with the passage of the elastomeric boot for receiving the ignition cable.

11. The ignition cable assembly as defined in claim 10 wherein the base terminal is mechanically inserted into the elastomeric boot.

12. The ignition cable assembly as defined in claim 10 wherein the elastomeric boot is over molded onto the base terminal.

13. The ignition cable assembly as defined in claim 10 further including a snap ring insert that is totally disposed inside the receptacle of the base terminal that communicates with the socket of the elastomeric boot for receiving the insulated electric device.

14. The ignition cable assembly as defined in claim 10 further including a snap ring insert that is totally disposed inside the socket of the base terminal that communicates with the passage of the elastomeric boot for receiving the insulated electric device.

15. The ignition cable assembly as defined in claim 14 further including a replaceable plug seal disposed in the socket of the elastomeric boot for sealingly engaging the insulator of the insulated electric device, the replaceable seal plug being made of a material that adheres to a ceramic insulator.

16. The ignition cable assembly as defined in claim 15 wherein the base terminal is mechanically inserted into the elastomeric boot.

17. The ignition cable assembly as defined in claim 15 wherein the elastomeric boot is over molded onto the base terminal.

* * * * *